United States Patent [19]

Streck et al.

[11] Patent Number: 4,776,947

[45] Date of Patent: Oct. 11, 1988

[54] METHOD OF DEHALOGENATING HYDROCARBON OILS

[75] Inventors: Roland Streck; Hans-Dieter Maier, both of Marl, Fed. Rep. of Germany

[73] Assignee: Huls Aktiengesellschaft, Marl, Fed. Rep. of Germany

[21] Appl. No.: 60,487

[22] Filed: Jun. 11, 1987

[30] Foreign Application Priority Data

Jun. 25, 1986 [DE] Fed. Rep. of Germany ..... 3621175

[51] Int. Cl.[4] ..... C10G 17/00

[52] U.S. Cl. ..... 208/262.1; 210/909

[58] Field of Search ..... 208/262; 210/909

[56] References Cited

U.S. PATENT DOCUMENTS

| | | | |
|---|---|---|---|
| 3,539,653 | 11/1970 | Frevel et al. | 208/262 |
| 4,327,027 | 4/1982 | Howard et al. | 260/340.3 |
| 4,337,368 | 6/1982 | Pytlewski et al. | 568/730 |
| 4,351,718 | 9/1982 | Brunelle | 208/262 |
| 4,400,552 | 8/1983 | Pytlewski et al. | 568/715 |
| 4,532,028 | 7/1985 | Peterson | 208/262 |
| 4,574,013 | 3/1986 | Peterson | 134/2 |
| 4,632,742 | 12/1986 | Tundo | 204/158.21 |
| 4,663,027 | 5/1987 | Menderatta . | |

FOREIGN PATENT DOCUMENTS 0021294 4/1981 European Pat. Off. ..... 208/262

OTHER PUBLICATIONS

Chemical Abstracts, Band 89, Nr. 5, 31. Jul. 1978, Seite 534, Zusammenfassung Nr. 42294s, Columbus, Ohio, US; S. G. Fedorov et al.: "Organoxycyclotriphosphazenes with Mixed Substituents", Zh. Obshch. Khim. 1978, 48(3), 533–5.

*Primary Examiner*—Curtis R. Davis
*Assistant Examiner*—Helane Myers
*Attorney, Agent, or Firm*—Oblon, Fisher, Spivak, McClelland & Maier

[57] ABSTRACT

Dehalogenation of hydrocarbon oils contaminated with haloorganic compounds is carried out by treatment with alkali or alkaline earth alcoholates (MOR) at 120°–400° C., wherein the alcoholates are soluble in the oils under the reaction conditions.

11 Claims, No Drawings

METHOD OF DEHALOGENATING HYDROCARBON OILS

BACKGROUND OF THE INVENTION

1. Field of the Invention

The invention relates to a method of dehalogenating hydrocarbon oils. The oils employed may be, for example, spent lubricating oils, which as a result of the treatment can be reused to produce re-refined products in a manner which conserves resources and does not pollute the environment. The oils may also be aromatic heat transfer oils, with which the method eliminates the corrosiveness caused by organochlorine compounds.

2. Discussion of the Background

During lubrication, lubricating oils experience increases in concentration of metal wear particles, as well as of their decomposition products, oxidation products, the fuel components. However, spent lubricating oils should not be regarded as waste products, because by means of various operations such as filtration, distillation, extraction with concentrated sulfuric acid or oleum, treatment with fuller's earth, and addition of new additives, they can be converted to highly valuable lubricants. These procedures regenerate a basic oil which poses no problems from a lubrication standpoint, using the spent lubricating oils as a starting material. However, certain impurities are carried along which are considered environmentally objectionable. Among these impurities are certain polychlorinated aromatics, which are mixed into the spent lubricating oils, sometimes by carelessness but sometimes intentionally or by technical accident (e.g., failure of a seal). Particularly significant impurities are the polychlorinated biphenyls (PCBs), which are widely disseminated as hydraulic oils in mining, and as insulating oils and dielectric media for transformers and capacitors, due to their incombustibility. For a number of years, PCBs have been a problem which has caused considerable apprehension, because they bioconcentrate similarly to DDT, and also when incinerated at temperatures below 1000° C. they can give rise to much more hazardous substances, namely polychlorinated dibenzodioxins and polychlorinated dibenzofurans. Indeed, there is concern that such conditions may sometimes occur in internal combustion engines. This has led to the conclusion that PCB-contaminated used oils should not be reprocessed but should only be incinerated at high temperature, unless they can be dechlorinated at reasonable expense. Therefore, for reasons of environmental protection and conservation of raw materials, it is a problem of urgent interest to develop economical methods of reprocessing used oils so that they can be reused.

An obvious approach to eliminating halogenated compounds is to heat the oil with dispersed alkali metals. This technique is described, for example, in British Pat. Nos. 2,063,908 and 2,081,298, and U.S. Pat. No. 4,465,490. The results are satisfactory, but substantial excess metal is required, due to the fact that the reaction takes place only at the metal-oil interface. The subsequent removal of the metal is beset with safety problems.

Another method, described in U.S. Pat. Nos. 4,284,516, 4,326,090, and 4,447,667, employs naphthalene-sodium as a dechlorinating agent in homogeneous solution. This necessarily introduces an additional solvent, which is usually tetrahydrofuran. The reaction is rapid, even at low temperatures. However, it is uneconomical on an industrial scale, because of the high consumption of solvent. In this instance, also, as with dispersed alkali metals, a substantial excess of the dechlorinating agent is required. The naphthalene itself, used in the reagent, is an environmental hazard in that it is an aromatic hydrocarbon.

Methods of dechlorinating by hydrogenation are also known. They require a large capital investment because of the pressure apparatus required. Accordingly, they can be made profitable only at relatively high capacities.

Methods of dechlorinating organochlorine compounds by means of chemical reducing agents have also been described. Thus, dechlorination can be accomplished by means of nickel chloride and sodium boranate in isopropanol (W. H. Dennis, Jr., et a., 1979, *Bull. Envir. Contam. Toxicol.*, 22 (6): 750–753), or by means of nickel chloride, triarylphosphine, and zinc dust, in dimethylformamide (U.S. Pat. No. 4,400,566), or by means of hydrazine hydrate in the presence of a palladium catalyst over activated carbon (Japanese No. 74-61143). The nature of the auxiliary reagents would be sufficient to disqualify these methods for industrial application, because of the novel waste disposal problems presented by the residues which are produced. Apart from this consideration, the auxiliary reagents are very costly.

With methods in which a mixture of alkali hydroxide and polyethylene glycol are reacted with the contaminated oil in the absence (U.S. Pat. No. 4,351,718) or in the presence (German OS No. 30 33 170, U.S. Pat. No. 4,400,552, U.S. Pat. No. 4,337,368, and European Pat. No. 0 118 858) of oxidizing agents, large amounts of reagents are also consumed.

In European Pat. No. 0 021 294, the dechlorination of toxic organic aromatic chlorine compounds is described, aimed primarily at treating manufacturing residues from 2,4,5-trichlorophenol production. The products are heated with alkali alcoholates (MOR) of monohydric alcohols with 1–5 carbon atoms, or polyalkylene glycols with 4–20 carbon atoms, or polyols with 2–5 carbon atoms and 2–3 hydroxyl groups, or monoalkyl ethers derived from the latter polyols and alcohols with 1–4 carbon atoms, employed in the presence of 0.5–1 equivalent of the free alcohol (based on the organically bonded halogen). Alternatively, mixtures of the aforementioned alcohols with alkali hydroxides and/or alkali carbonates may be used. In general, sodium glycolate/ethylene glycol is used for dechlorination. In order to use sodium ethoxide/methanol, one must resort to high pressures.

The method of European Pat. No. 0 021 294 completely decomposes the manufacturing residues. Based on what has been disclosed of the reaction conditions, it is not suitable for processing large amounts of only slightly contaminated oils which are intended for reuse. In addition, it involves heterogeneous reactions, and is therefore cumbersome to integrate into a continuous production process.

SUMMARY OF THE INVENTION

Accordingly, one object of the present invention is to provide a method of dehalogenating halogen-containing hydrocarbon oils which is rapid and goes to completion.

Another object of the invention is to provide a method which requires only small amounts of costly auxiliary reagents.

Still a further object of the invention is to provide a method which does not pose safety or environmental problems in disposing of waste residues.

These and other objects of the present invention which will become apparent from the following specification have been achieved by the present method of dehalogenating halogen-containing hydrocarbon oils, which comprises the steps of (a) treating the halogen-containing hydrocarbon oil in a homogeneous phase with $C_{6-25}$ alkali or alkaline earth alcoholates, at 120°–400° C. to form alkali or alkaline earth halides; and (b) separating out the halides which are formed.

DETAILED DESCRIPTION OF THE PREFERRED EMBODIMENTS

The problems associated with prior art processes are avoided by the method of the present invention, in which the hydrocarbon oils contaminated with haloorganic compounds are treated with alkali or alkaline earth alcoholates (MOR) with 6–25 carbon atoms, at 120°–400° C. This produces alkali or alkaline earth halides which precipitate out and can be removed by filtration, washing, or as components of a distillation residue. Excess reagents can be converted to insoluble inorganic salts by addition of small amounts of acids or acid salts, or can be bound to fuller's earth and filtered out. They pose no new hazard to the environment.

The oils used for the inventive method may be hydrocarbon oils such as heat transfer oils, insulating oils, hydraulic oils, heavy oils, lubricating oils, neutral oils, fractions derived from used oils, paraffin oils, or organic hydrocarbon intermediate products.

An important criterion for the present method is that the alcoholate employed be soluble in the hydrocarbon oils under the given reaction conditions. This solubility criterion is met by all alcoholates having straight-chain, branched, or cyclic alkyl groups with at least 6 carbon atoms. There is a practical upper limit of 25 carbon atoms, imposed by the general availability of the alcohols more than by questions of effectiveness. However, in the case of a large alkyl group the relative amount of active alcoholate groups is low. Alcoholates with alkyl groups having 8–20 carbon atoms are of industrial importance. Alkyl groups with 8–14 carbon atoms represent a particularly advantageous compromise wherein good solubility and market availability are combined with a still favorable amount of active groups.

The alcohols suitable for preparing the dehalogenation agents include, for example, the following: 1-, 2-, and 3-hexanol; 1, 2-, 3-, and 4-heptanol; 1-, 3-, and 4-octanol; 1-, 2-, 3-, 4-, and 5-nonanol; 1-, 2-, 3-, 4-, and 5-decanol; 1-, 2-, 3-, 4-, 5-, and 6-undecanol; 1-, 2-, 3-, 4-, 5-, and 6-dodecanol; 1-, 2-, 3-, 4-, 5-, 6-, and 7-tridecanol; 1-, 2-, 3-, 4-, 5-, 6-, and 7-tetradecanol (myristyl alcohol); 1-, 2-, 3-, 4-, 5-, 6-, 7-, and 8-pentadecanol; 1-octadecanol (stearyl alcohol), 2-, 3-, 4-, 5-, 6-, 7-, 8-, and 9-octdecanol; 1-, 2-, 3-, 4-, 5-, 6-, 7-, 8-, 9- and 10-nonadecanol; and 1-, 2-, 3-, 4-, 5-, 6-, 7-, 8-, 9- and 10-eicosanol; and higher homologs, and branched isomers of these and of the homologs; as well as cyclohexanol, cycloheptanol, cyclooctanol, cyclononanol, cyclodecanol, cycloundecanol, cyclododecanol, cyclotridecanol, cyclotetradecanol, cyclopentadecanol, cyclohexadecanol, cycloheptadecanol, cyclooctadecanol, cyclonoadecanol, and cycloeicosanol; and alkylated and arylated derivatives of these cycloaliphatic compounds. Also suitable are hydrogenated naphthols, benzyls, benzyl alcohol, alpha- and beta-phenylethanol, 1-undecen-11-ol, oleyl alcohol, cinnamic alcohol, benzyhydrol, 2-hydroxymethylbicyclo-[2.2.1]-heptane, etc.

Many of these alcohols may be prepared on an industrial scale from petrochemical or natural feedstocks by reactions such as hydrogenation of esters, hydroformylation or hydration of olefins, Guerbet reaction of lower alcohols, oxidation with subsequent hydrolysis of higher alkylaluminums, etc. Particularly preferred alcohols are the branched alcohols with 8–14 carbon atoms which are customarily used in the manufacture of plasticizers for PVC; e.g., 2-ethyl-1-hexanol; "isonoanol", "isodecanol", and "isotridecanol" (these three are hydroformylation products of butene dimer, propene trimer, and butene trimer or propene tetramer, respectively.) They are preferred because their alkoxides have particularly good solubility in hydrocarbon oils.

The alcoholates of the above-mentioned alcohols with alkali and/or alkaline earth metals may be used as dehalogenating agents. The preferred alkali metals are sodium and postassium; the preferred alkaline earth metals are magnesium and calcium. The alkali alcoholates are particularly preferred.

The alcoholates may be prepared by any known method; for example (i) by reacting a metal or metal hydride with the alcohol to form water as a byproduct; (ii) by reacting a lower alcoholate (MOR) with a higher alcohol followed by distilling off of the lower alcohol; or (iii) by reacting a metal hydroxide and an alcohol with azeotropic distillation and removal of the water present at equilibrium. The preparation may also be carried out in situ, in the presence of the substrate which is to be dehalogenated. It is not necessary that the alcoholate be employed in the presence of excess alcohol; however, a moderate excess is not detrimental.

The stoichiometrically required amount of alcoholate is based on the halogen content, taking into account also the moisture content and the content of acid- and ester groups which will react with the alcoholate. The amount of reagent actually used will be 0.5–5 times the stoichiometric amount. Even substantial excesses will not cause problems, but are avoided for reasons of process engineering and cost. The preferred amounts of reagent are 1.5–5 times the stoichiometric amount. Ordinarily a small excess is sufficient, when operating in the upper region of the temperature range.

Suitable temperatures for dehalogenation according to the invention are 120°–400° C. Reaction times range from up to 10 hr at the lower temperature limit to a few seconds at the upper limit. Preferred temperatures are 180°–380° C. The temperature range 220°–350° C. is particularly preferred.

The present dehalogenation method is suitable for removing any halogen from the halogen-containing hydrocarbon oils. Halogens which can be removed include fluorine, chlorine bromine, and iodine. The method is particularly suited for the removal of chlorine and bromine from hydrocarbon oils and more particularly suited for removal of chlorine from chlorine-containing hydrocarbon oils.

In conventional used-oil processing, temperatures in the above-mentioned ranges occur in present-day processes in the distillation stages. Therefore, the dehalogenation can be integrated into the process, given proper engineering, without the need for additional reactors. A conventional heated reactor may be employed for batchwise dehalogenation of small batches. The method is applicable when integrated within a continuous process or for these small batch operations as well.

Because the alcoholates used are hydrocarbon-soluble, the dehalogenation can be carried out without added solvent, in a homogeneous phase. This enables minimal consumption of chemicals, and short reaction times. In addition, the disposal of the residues which develop does not present safety or environmental problems.

Other features of the invention will become apparent in the course of the following descriptions of exemplary emobdiments which are given for illustration of the invention and are not intended to be limiting thereof.

EXAMPLES

Example 1

Dechlorinating reagent: 18 g sodium and 130 g 2-ethyl-1-hexanol were stirred for 6 hr at 150° C. and 1 hr at 200° C., under nitrogen. A clear liquid was produced, comprising 148 g of 80% Na-ethylhexanoxide.

Hydrocarbon oil: A reprocessed used halogen-containing oil was fed, which had not yet had new additives added to it.

| | |
|---|---|
| Chlorine content 45 ppm = | 1.3 mmol/kg oil |
| Water content 50 ppm = | 2.8 mmol/kg oil |
| Saponification number | |
| 0.9 mg KOH/g = | 16.0 mmol/kg oil |
| Total = | 20.1 mmol/kg oil |

Accordingly, the theoretical stoichiometric amount of dechlorinating agent is 3.1 g Na-ethylhexanoxide per kg oil.

Dechlorination: 500 g reprocessed used oil was reacted with 7.9 g 80% Na-ethylhexanoxide and then stirred 30 min at 350° C. A sample was taken, the precipiated NaCl in the sample was filtered out, and organically bound chlorine was determined by the Wickbold combustion method. The analytical results are presented in Table 2.

The used oil was cooled to room temperature. Excess Na-ethylhexanoxide was decomposed by treatment with concentrated sulfuric acid. After filtration and removal of the inorganic salts, the used oil was distilled under vacuum.

Examples 2 to 10

The procedure used was the same as in Example 1. The hydrocarbon oils used are listed in Table 1.

TABLE 1

| Example Nos. | Oil Used | Stoichiometric amount of alcoholate per kg oil |
|---|---|---|
| 2, 3 | Reprocessed Used Oil | 3.1 g Na—ethylhexanoxide |
| 4 | Reprocessed Used Oil | 3.4 g Na—isononylate, 48% in "isononanol"[1] |
| 5, 6 | Reprocessed Used Oil | 3.5 g Na—ethylhexanoxide |
| 7 | Used oil prior to reprocessing | 47.0 g Na—ethylhexanoxide |
| 8, 9 | Used oil prior to reprocessing | 19.2 g Na—ethylhexanoxide |
| 10 | Paraffin oil to which 500 ppm trichlorobiphenyl[2] had been added | 0.9 g Na—ethylhexanoxide |

TABLE 1-continued

[1]"Isononanol" is a mixture prepared by hydroformylating butene dimers, and is comprised principally of 4,5-dimethyl-1-heptanol, 2,5-dimethyl-1-heptanol, 3-ethyl-1-heptanol, 6-methyl-1-octanol, 4-methyl-1-octanol, and 3-ethyl-4-methyl-1-hexanol.

[2]Chlophen A 30 ®, supplied by Bayer AG, of D-5090 Leverkusen, West Germany.

The results of the dechlorination experiments are given in Table 2.

TABLE 2

| Example No. | Amount of alcoholate used (no. of times stoichiometric) | Temp. °C. | ppm Cl at start | after 30 min. | after 60 min. | after 120 min. |
|---|---|---|---|---|---|---|
| 1 | 4.1 | 350 | 45 | 1 | | |
| 2 | 5.0 | 350 | 45 | 1 | | |
| 3 | 5.0 | 250 | 45 | 6 | | |
| 4 | 5.0 | 350 | 45 | 3 | | |
| 5 | 2.3 | 350 | 150 | 18 | | |
| 6 | 3.5 | 350 | 150 | 10 | | |
| 7 | 1.5 | 230 | 3,600 | 190 | 150 | 70 |
| 8 | 0.58 | 290 | 950 | | 85 | |
| 9 | 0.74 | 330 | 950 | | 60 | |
| 10 | 5.0 | 350 | 215 | 32 | 29 | |

Example 11

Dechlorination of a raw dibenzyltoluene

The raw material was 500 g of a mixture of isomers of dibenzyltoluene intended for use as a heat transfer oil, containing chlorine in the amount of 1,200 ppm. The stoichiometric amount of alcoholate is 5.1 g Na-ethylhexanoxide per kg oil.

The chlorine content was reduced to 4 ppm by double distillation at normal pressure and 360° C. over Na-ethylhexanoxide.

93 wt.% of the raw product fed was obtained in the distillate.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of dehalogenating a halogen-containing hydrocarbon oil, comprising the steps of:

(i) treating a halogen-containing hydrocarbon oil in a homogeneous phase with an alkali or alkaline earth $C_{6-25}$ alcoholate, at 120°–400° C. to form alkali or alkaline earth halides; and (ii) separating out said halides.

2. The method of claim 1, wherein said alcoholate is a $C_{8-20}$ alcoholate.

3. The method of claim 1, wherein said alcoholate is a sodium or potassium alcoholate or mixtures thereof.

4. The method of claim 1, wherein said alcoholate is a sodium or potassium $C_{8-14}$ alcoholate or mixtures thereof.

5. The method of claim 1, wherein said treating step is conducted at a temperature between about 180°–380° C.

6. The method of claim 5, wherein said treating step is conducted at a temperature between about 220°–350° C.

7. The method of claim 1, wherein said alcoholate is present in an amount of 0.5–5 times the stoichiometric amount.

8. The method of claim 7, wherein said alcoholate is present in an amount of about 1.5–5 times the stoichiometric amount.

9. The method of claim 1, wherein said alcoholate is sodium 2-ethyl-1-hexanoxide.

10. The method of claim 1, wherein the alkaline earth metal of said alcoholate is magnesium or calcium.

11. The method of claim 1, wherein the alcohol from which said alcoholate is formed is a member selected from the group consisting of 1-, 2- or 3-hexanol; 1, 2-, 3- or 4-heptanol; 1-, 3- or 4-octanol; 1-, 2-, 3-, 4- or 5-nonanol; 1-, 2-, 3-, 4- or 5-decanol; 1-, 2-, 3-, 4-, 5- or 6-undecanol; 1-, 2-, 3-, 4-, 5- or 6-dodecanol; 1-, 2-, 3-, 4-, 5-, 6- or 7-tridecanol; 1-, 2-, 3-, 4-, 5-, 6- or 7-tetradecanol; 1-, 2-, 3-, 4-, 5-, 6-, 7- or 8-pentadecanol; 1-octadecanol, 2-, 3-, 4-, 5-, 6-, 7-, 8- or 9-octadecanol; 1-, 2-, 3-, 4-, 5-, 6-, 7-, 8-, 9- or 10-nonadecanol; 1-, 2-, 3-, 4-, 5-, 6-, 7-, 8-, 9- or 10-eicosanol; higher homologs thereof containing up to 25 carbon atoms; branched isomers of these alcohols; cyclohexanol, cycloheptanol, cyclooctanol, cyclononanol, cyclodecanol, cycloundecanol, cyclododecanol, cyclotridecanol, cyclotetradecanol, cyclopentadecanol, cyclohexadecanol, cycloheptadecanol, cyclooctadecanol, cyclononadecanol, cycloeicosanol, alkylated and arylated derivatives of said cycloaliphatic alcohols, naphthol, benzyl alcohol, $\alpha$- or $\beta$-phenylethanol, 1-undecen-11-ol, oleylalcohol, cinnamic alcohol, benzhydrol, and 2-hydroxymethylbicyclo-[2,2,1]-heptane.

* * * * *

UNITED STATES PATENT AND TRADEMARK OFFICE

CERTIFICATE OF CORRECTION

PATENT NO. : 4,776,947

DATED : October 11, 1988

INVENTOR(S) : Roland Streck et al

It is certified that error appears in the above-identified patent and that said Letters Patent is hereby corrected as shown below:

| Column | Line | |
|---|---|---|
| 2, | 17, | delete "a.," and insert --al.,--, |
| 3, | 60, | delete "octdecanol" and insert --octadecanol--, |
| | | insert --,-- after "9-", |
| | 61, | insert --,-- after "9-", |
| | 68, | delete "cyclonoadecanol" and insert --cyclononadecanol--, |
| 4, | 2 & 3, | delete "ben-zyls,", |
| | 4 & 5, | delete "benzyhydrol" and insert --benzhydrol--, |
| | 5, | delete "2.2.1" and insert --2,2,1--, |
| | 14, | delete "isonoanol" and insert --isononanol--, |
| | 18, | delete ".)" and insert -- ). --, |
| | 40, | delete "-" after --acid--, |
| | 58, | insert --,-- after "chlorine", |
| 5, | 15, | delete "emobdiments" and insert --embodiments--, |
| | 41 & 42, | delete "precipiated" and insert --precipitated--, |

UNITED STATES PATENT AND TRADEMARK OFFICE

CERTIFICATE OF CORRECTION

PATENT NO. : 4,776,947

DATED : October 11, 1988

INVENTOR(S) : Roland Streck et al

It is certified that error appears in the above-identified patent and that said Letters Patent is hereby corrected as shown below:

| Column | Line | |
|---|---|---|
| 7, | 13, | delete "l", (second occurrence) and insert --1-, --. |

Signed and Sealed this

Sixth Day of June, 1989

*Attest:*

*Attesting Officer*

DONALD J. QUIGG

*Commissioner of Patents and Trademarks*